US007243600B1

(12) United States Patent
Boettcher

(10) Patent No.: US 7,243,600 B1
(45) Date of Patent: Jul. 17, 2007

(54) INK PAN FOR A ROTOGRAVURE PRINTING PRESS

(75) Inventor: Steven E. Boettcher, Neenah, WI (US)

(73) Assignee: Flxon Incorporated, Charlotte, NC (US)

( * ) Notice: Subject to any disclaimer, the term of this patent is extended or adjusted under 35 U.S.C. 154(b) by 0 days.

(21) Appl. No.: 11/416,558

(22) Filed: May 3, 2006

(51) Int. Cl.
*B41F 1/08* (2006.01)
*B41F 31/07* (2006.01)

(52) U.S. Cl. ..... 101/350.5; 101/153; 101/157; 101/363

(58) Field of Classification Search ..... 101/350.5, 101/350.1, 364, 157, 169, 155, 167, 153, 101/363
See application file for complete search history.

(56) References Cited

U.S. PATENT DOCUMENTS 2,368,500 A * 1/1945 Taylor et al. ..... 101/350.6
2,631,532 A 3/1953 Harless
3,045,592 A * 7/1962 Shearer et al. ..... 101/350.1
3,718,115 A 2/1973 Lee
4,158,333 A * 6/1979 Navi ..... 101/363
4,497,250 A * 2/1985 Dressler ..... 101/350.5
5,079,044 A * 1/1992 Schumacher et al. .... 427/207.1
5,280,750 A * 1/1994 Yoshida et al. ..... 101/363
5,749,293 A 5/1998 Ota et al.
6,024,015 A 2/2000 Dillig et al.
6,471,773 B1 * 10/2002 Atkins ..... 118/123
6,619,205 B2 9/2003 Maier
6,640,703 B2 11/2003 Fukumori et al.

* cited by examiner

*Primary Examiner*—Leslie J Evanisko
(74) *Attorney, Agent, or Firm*—Hammer & Hanf, P.C.

(57) ABSTRACT

An ink pan for a rotogravure printing press has a reservoir and a dam. The dam is located within the reservoir and divides the reservoir into an intake section and an outtake section. A gate is within the dam. The gate has an open position and a closed position. When the gate is closed the dam maintains an ink in the intake section until the ink exceeds a depth greater than the height of the dam, and then the ink flows over the dam into the outtake section. When the gate is in an open position the gate allows ink in the intake section to be emptied into the outtake section.

12 Claims, 3 Drawing Sheets

INK PAN FOR A ROTOGRAVURE PRINTING PRESS

FIELD OF INVENTION

The instant invention relates to an ink pan for a rotogravure printing press.

BACKGROUND OF THE INVENTION

A rotogravure printing press uses a direct printing process where the ink is transferred directly to a printing surface (e.g. a paper or plastic web) from small cells that are engraved into the surface of a gravure cylinder. The rotogravure printing press typically consists of the gravure cylinder, a doctor blade, an impression roller, an ink pan system, and an inking system. In operation, the gravure cylinder is rotated in the filled ink pan system and the engraved cells pickup the ink as the gravure cylinder turns. Excess ink is wiped from the gravure cylinder surface by the doctor blade and is returned to the ink pan system. The printing surface (e.g. the paper or plastic web) is pressed onto the gravure cylinder surface by the impression roller, resulting in a direct ink transfer from the inked cells of the gravure cylinder to the printing surface.

The ink pan system consists of two pans, an inner pan and an outer pan. Each pan may have a concave shape. The inner pan holds the ink for pickup by the rotating gravure cylinder. The outer pan receives ink from the inner pan via gravity. In operation, the ink is pumped into the inner pan and then drains through small holes in the bottom of the inner pan and/or cascades over the inner pan into the outer pan. The ink drains out of the bottom of the outer pan through an opening into a drain hose and then into an ink sump via gravity.

There are several problems with the foregoing two pan system. Some known problems include: the amount of ink needed to operate the rotogravure press, the amount of ink left in the ink pan system after operation, the pump pressure needed to sustain the amount of ink in the ink pan system, the amount of man hours needed to clean parts after operation, and the scumming, bubbling, and swirling affect of the ink in front of the gravure cylinder which causes color voids in the print.

There is a need for an ink pan system that addresses the foregoing problems.

SUMMARY OF THE INVENTION

The instant invention is an ink pan for a rotogravure printing press. The ink pan has a reservoir and a dam. The dam is located within the reservoir and divides the reservoir into an intake section and an outtake section. A gate is within the dam. The gate has an open position and a closed position. When the gate is closed, the dam maintains an ink in the intake section until the ink exceeds a depth greater than the height of the dam, and then the ink flows over the dam into the outtake section. When the gate is in an open position, the gate allows ink in the intake section to be emptied into the outtake section.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
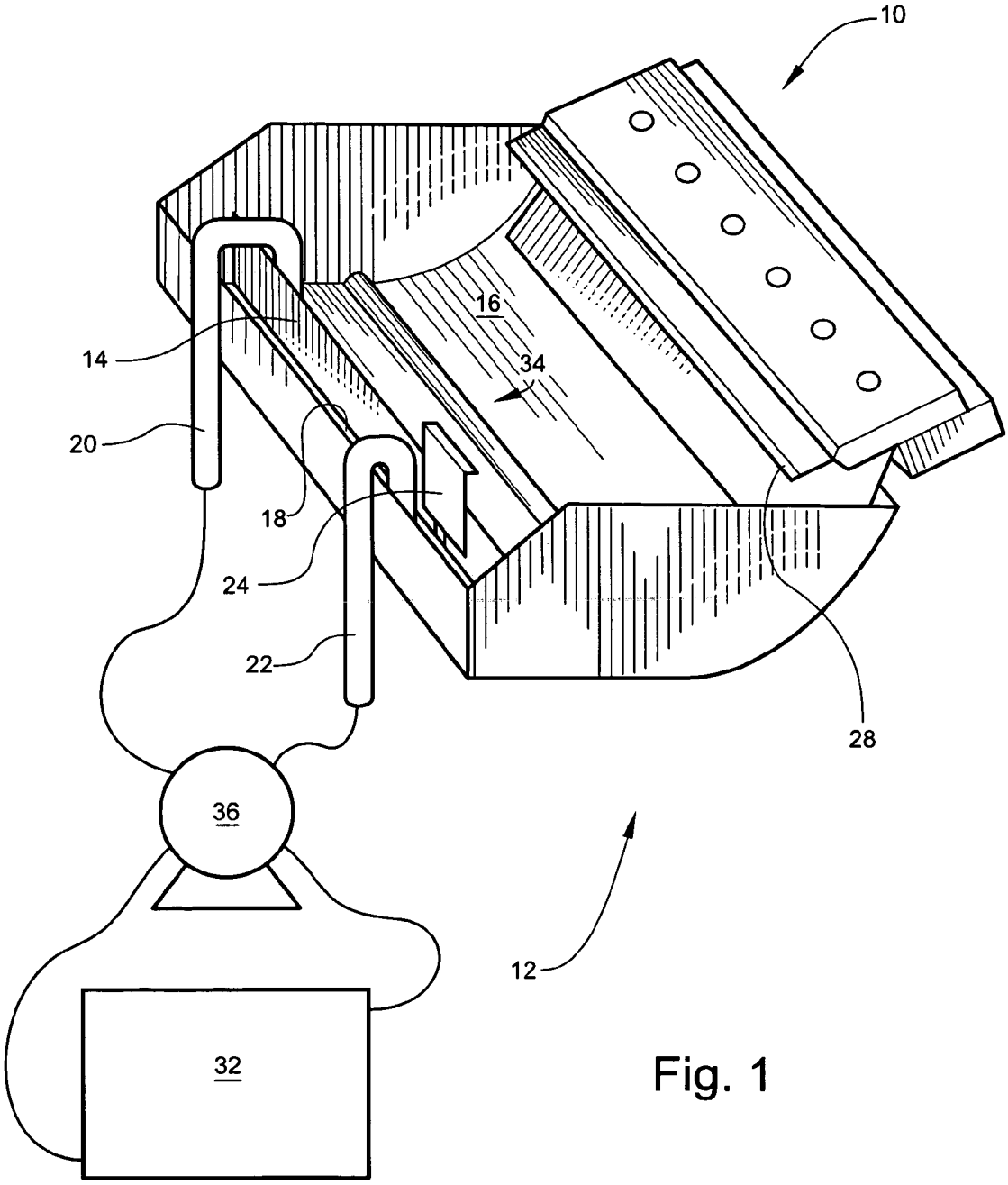
FIG. 1 is an isometric view of an embodiment of the ink pan.

Referring to the drawings, wherein like numerals indicate like elements, there is shown in FIG. 1 an embodiment of an ink pan 10 for a rotogravure printing press. Ink pan 10 generally comprises a reservoir 12. Reservoir 12 may be an open top tank capable of holding an ink 8 (seen in FIGS. 2-3). Reservoir 12 may have a dam 14 between an intake section 16 and an outtake section 18.

Intake section 16 may be adapted to receive ink 8 into reservoir 12. Ink 8 may be introduced into intake section 16 by an inlet 20. Intake section 16 may be adapted to allow a gravure cylinder 26 to turn within it where ink 8 within intake section 16 may be picked up by the gravure cylinder 26 (seen in FIGS. 2-3). Intake section 16 may have a greater volume than outtake section 18 allowing gravure cylinder 26 to rotate within intake section 16. Intake section 16 may be adapted to receive an excess of ink 8 removed from gravure cylinder 26 by a doctor blade 28 (seen in FIGS. 1-3).

Inlet 20 may be in communication with intake section 16. Inlet 20 may be for moving ink 8 into intake section 16. Inlet 20 may be any type of conduit for moving ink 8 into intake section 16. See FIGS. 1-2.

Outtake section 18 may be adapted to receive ink 8 from intake section 16. Ink 8 may be received by outtake section 18 from intake section 16 by ink 8 cascading over dam 14 or by ink 8 moving through a gate 24 within dam 14 (seen in FIG. 1). Outtake section 18 may be adapted to remove ink 8 from reservoir 12. Ink 8 may be removed from outtake section 18 by an outlet 22.

Outlet 22 may be in communication with outtake section 18. Outlet 22 may be for removing ink 8 from outtake section 18. Outlet 22 may be any conduit for removing ink 8 from outtake section 18. See FIGS. 1 and 3.

Dam 14 may divide intake section 16 from outtake section 18. Dam 14 may be adapted to maintain ink 8 in intake section 16 up to the height of dam 14. Dam 14 may be any structure capable of dividing intake section 16 from outtake section 18. Dam 14 may be a wall within reservoir 12. See FIG. 1. Dam 14 may include the gate 24.

Gate 24 may be a gate within dam 14. Gate 24 may have an open position and a closed position. Gate 24 may be in the open position when ink 8 from intake section 16 empties into outtake section 18. Gate 24 may be in the closed position when ink 8 from intake section 16 is maintained in intake section 16 up to the height of dam 14. Gate 24 may be any gate capable of opening and closing. Gate 24 may be a gate that is opened by sliding vertically upward (seen in FIG. 1). Gate 24 may be closed by sliding vertically downward.

Doctor blade 28 may work with ink pan 10. Doctor blade 28 may remove the excess of ink 8 from gravure cylinder 26. Doctor blade 28 may be any device capable of removing the excess of ink 8 from gravure cylinder 26. Doctor blade 28 may be positioned so that the excess of ink 8 removed from gravure cylinder 26 falls into intake section 16. See FIGS. 1-3.

A vortex promoter 34 may be located within reservoir 12. Vortex promoter 34 may be for creating turbulence in ink 8 between reservoir 12 and gravure cylinder 26. Vortex promoter 34 may be located below dead center of gravure cylinder 26. See FIGS. 2-3. Vortex promoter 34 may be any apparatus capable of causing turbulence in ink 8 between reservoir 12 and gravure cylinder 26. Vortex promoter 34 may be a rounded strip within reservoir 12 that is attached to the surface of reservoir 12 (seen in FIGS. 1-3).

A two-way pump 36 may be connected with inlet 20 and outlet 22. Two-way pump 36 may be for moving ink 8 from an ink supply system 32 through inlet 20 into intake section 16 and for moving ink 8 from outtake section 18 through outlet 22 into ink supply system 32. Two-way pump 36 may be any pump capable of moving ink 8 through two different conduits.

Ink supply system 32 may be for storing ink 8 and for preparing ink 8 for printing. Ink supply system 32 may be any device capable of storing ink 8 and preparing ink 8 for printing. Ink supply system 32 may be connected with inlet 20 and may be connected with outlet 22. See FIG. 1.

A clearance tube 38 may be located within outtake section 18. See FIG. 2. Inlet 20 may be in communication with intake section 16 through clearance tube 38 located within outtake section 18. Clearance tube 38 may allow inlet 20 to move ink 8 into intake section 16 without having to go over outtake section 18. Clearance tube 38 may be any structure that allows inlet 20 to move ink 8 into intake section 16 through outtake section 18. Clearance tube 38 may be a tube located within outtake section 18.

During printing, ink 8 may be moved through ink pan 10. Ink 8 begins in ink supply system 32 where it may be prepared for printing. Ink 8, when prepared for printing by ink supply system 32, may be moved from ink supply system 32 into intake section 16 through inlet 20 by two-way pump 36. Gate 24 may be closed and ink from intake section 16 may cascade over dam 14 into outtake section 18. Ink from outtake section 18 may be removed through outlet 22 by two-way pump 36 to ink supply system 32. Ink supply system 32 may store ink 8 and prepare ink 8 again for printing.

While ink 8 is being moved from ink supply system 32 to intake section 16, clearance tube 38 may provide a shorter path from ink supply system 32 to intake section 16. A shorter path from ink supply system 32 may reduce the amount of pump pressure needed to sustain the amount of ink 8 in ink pan 10.

While ink 8 may be moved into intake section 16 and gate 24 may be closed, dam 14 may maintain ink 8 in intake section 16 up to the height of dam 14. Ink 8 in intake section 16 that exceeds the height of dam 14 may flow over dam 14 into outtake section 18. The part of ink 8 that flows over dam 14 may be the top layer of ink 8. The top layer of ink 8 typically is where scumming, bubbling, and the swirling effect take place. Allowing this top layer of ink 8 to flow over dam 14 provides circulation in the top layer of ink 8, which reduces the amount of scumming, bubbling, and the swirling effect that take place in front of gravure cylinder 26.

While ink 8 moves into outtake section 18 from intake section 16, ink 8 from outtake section 18 may be removed by two-way pump 36 through outlet 22 and into ink supply system 32. Two-way pump 36 may allow ink 8 to be pumped directly to the ink supply system 32 and eliminates the need for a drain hose and ink sump, which may reduce the amount of parts needed to be cleaned. Thus ink pan 10 may reduce the amount of man hours needed to clean parts after operation.

Figure 2:
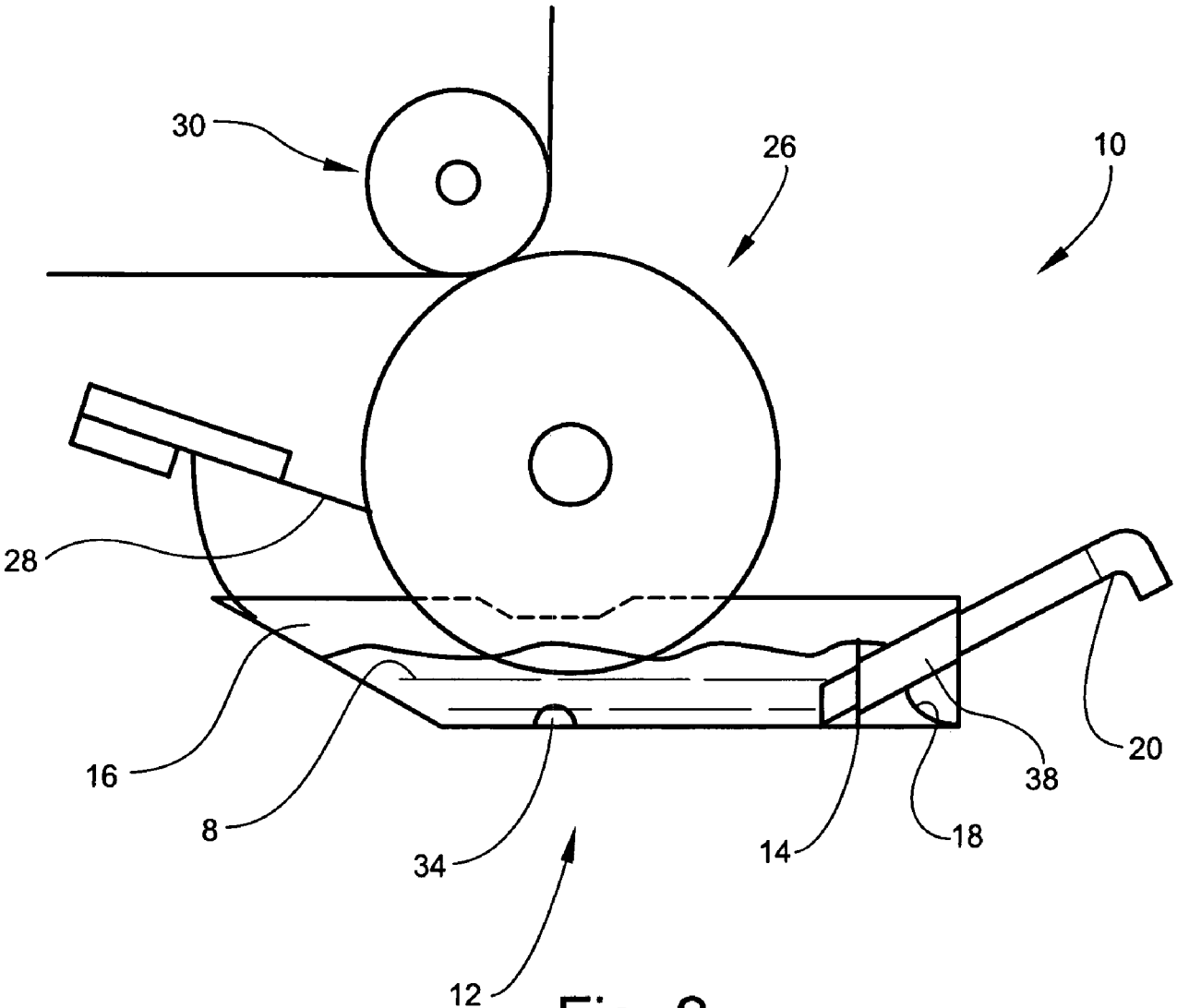
FIG. 2 is a side elevated view of an embodiment of the ink pan.
Figure 3:
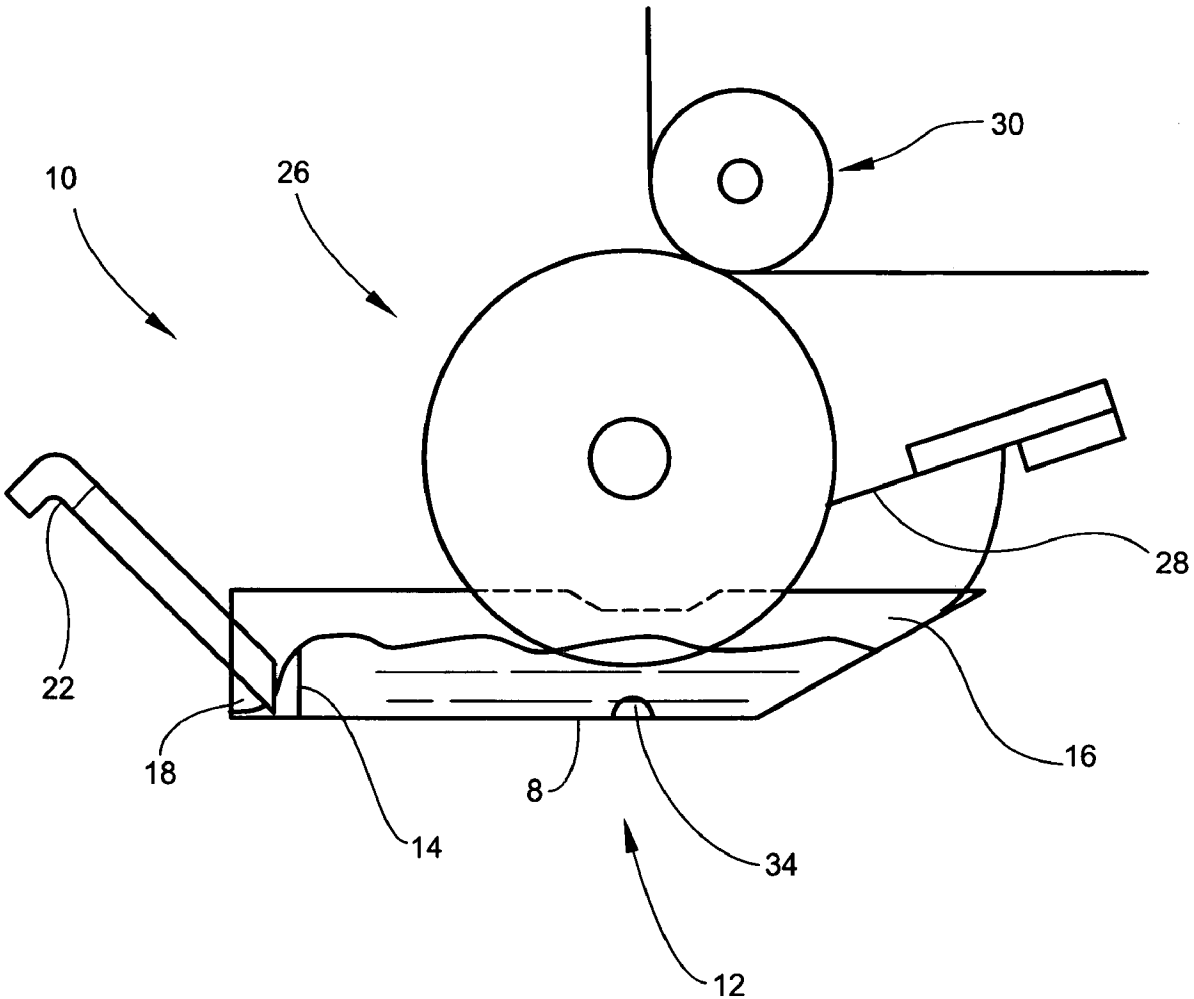
FIG. 3 is a side elevated view of the ink pan of FIG. 2.

While ink 8 may be moved through ink pan 10, gravure cylinder 26 may be rotated within intake section 16 and ink 8 may be picked up by gravure cylinder 26 (best seen in FIGS. 2 and 3). After gravure cylinder 26 has been rotated within intake section 16, doctor blade 28 may remove the excess of ink 8 from gravure cylinder 26. The excess of ink 8 may fall back into intake section 18. Allowing the excess of ink 8 to be put back into ink pan 10 for operation may reduce the amount of ink 8 needed to operate the rotogravure printing press and may reduce the pump pressure needed to sustain ink 8 in ink pan 10.

After doctor blade 28 removes the excess of ink 8, a printing surface 31 may be applied to the surface of gravure cylinder 26. See FIGS. 2-3. The printing surface 31 may be applied to the surface of gravure cylinder 26 by an impression roller 30. The application of the printing surface 31 to the surface of the gravure cylinder 26 may result in a direct ink transfer from the surface of gravure cylinder 26 to the printing surface 31.

While gravure cylinder 26 may be spinning in intake section 16, vortex promoter 34 may cause turbulence between reservoir 12 and gravure cylinder 26. Ink 8 may be applied more efficiently to gravure cylinder 26 when turbulence between reservoir 12 and gravure cylinder 26 is increased. More efficient application of ink 8 to gravure cylinder 26 may reduce the amount of ink 8 needed to apply to gravure cylinder 26 and ink pan 10 may be shallow relative to the size of gravure cylinder 26. See FIGS. 2-3. Ink pan 10 being shallow relative to the size of gravure cylinder 26 may reduce the amount of ink 8 needed to fill the rotogravure printing press and may reduce the pump pressure needed to sustain ink 8 in ink pan 10.

After printing, ink 8 may be removed and cleaned from ink pan 10. Gate 24 may be opened to facilitate removal of ink 8 from ink pan 10 and facilitate the cleaning of ink pan 10. Ink 8 from intake section 16 may empty into outtake section 18 when gate 24 is opened. Emptying of intake section 16 may allow all of ink 8 in ink pan 10 to be emptied, which may reduce the amount of ink 8 left in the rotogravure printing press after operation. Ink pan 10 may be a single pan that includes a means for bringing ink 8 into intake section 16 and may be a means for removing ink 8 from outtake section 18. Ink pan 10 may eliminate the need for a two pan system with an inner and an outer pan, which may reduce the amount of parts needed to be cleaned. Thus, ink pan 10 may reduce the amount of man hours needed to clean parts after operation.

Ink 8 from outtake section 18 may be removed by two-way pump 36 through outlet 22 into ink supply system 32. Two-way pump 36 may provide a more efficient way of removing ink 8 from ink pan 10 than just relying on the force of gravity. Providing a force greater than gravity for removing ink 8 from ink pan 10 may reduce the amount of ink 8 left in the rotogravure printing press after operation. Thus ink pan 10 may reduce the amount of man hours needed to clean parts after operation.

After ink 8 is emptied from ink pan 10, two-way pump 36 may move a cleaning fluid through inlet 20 into ink pan 10 and out of ink pan 10 through outlet 22. The cleaning fluid may be for removing ink 8 remaining in ink pan 10, inlet 20 and outlet 22. By moving a cleaning fluid through ink pan 10, inlet 20 and outlet 22, two-way pump 36 may reduce the amount of ink 8 left in ink pan 10, inlet 20 and outlet 22 after operation. Thus, ink pan 10 may reduce the amount of man hours needed to clean parts after operation.

The present invention may be embodied in other forms without departing from the spirit and the essential attributes thereof, and, accordingly, reference should be made to the appended claims, rather than to the foregoing specification, as indicated in the scope of the invention.

I claim:

1. An ink pan for a rotogravure printing press comprising:

a reservoir with an open top and a bottom for holding an ink;

a dam within said reservoir dividing said reservoir into an intake section and an outtake section;

a vortex promoter located within said reservoir creating turbulence in the ink between a gravure cylinder and said reservoir;

said vortex promoter being a protrusion along said bottom of said reservoir; and a gate within said dam having an open position and a closed position;

when said gate being in said closed position, said dam maintains ink in said intake section up to a height of said dam where said ink flows over said dam into said outtake section; and when said gate being in said open position, ink from said intake section empties to said outtake section.

2. The ink pan of claim 1 where said rotogravure printing press comprising:

a said gravure cylinder operatively positioned within said ink pan;

a doctor blade operatively associated with said gravure cylinder;

an impression roller operatively associated with said gravure cylinder; and an ink supply system operatively associated with said ink pan.

3. The ink pan of claim 2 wherein said vortex promoter being located in said reservoir directly below a bottom dead center of said gravure cylinder.

4. The ink pan of claim 2 wherein said doctor blade works with said ink pan.

5. The ink pan of claim 4 wherein said doctor blade being positioned where excess ink removed by said doctor blade being able to fall into said intake section.

6. The ink pan of claim 1 wherein said intake section has a larger volume than said outtake section.

7. The ink pan of claim 1 further comprising an inlet and an outlet;

said inlet being in communication with said intake section; and said outlet being in communication with said outtake section.

8. The ink pan of claim 7 further comprising a two-way pump being in communication with said inlet and said outlet, said two-way pump moving ink into said intake section through said inlet and moving ink from said outtake section through said outlet.

9. The ink pan of claim 7 wherein said inlet communicates with said intake section through a clearance tube within said outtake section.

10. The ink pan of claim 7 where said inlet and said outlet being below a center of said gravure cylinder.

11. The ink pan of claim 1 where said protrusion being a rounded strip.

12. An ink pan for a rotogravure printing press comprising:

a reservoir with an open top and a bottom for holding an ink;

a dam within said reservoir dividing said reservoir into an intake section and an outtake section;

a vortex promoter being a protrusion along said bottom of said reservoir below a bottom dead center of a gravure cylinder;

said vortex promoter creating turbulence in the ink between said gravure cylinder and said reservoir; and a gate within said dam having an open position and a closed position;

when said gate being in said closed position, said dam maintains ink in said intake section up to a height of said dam where said ink flows over said dam into said outtake section; and when said gate being in said open position, ink from said intake section empties to said outtake section.

* * * * *